US007533461B2

(12) United States Patent
Griffiths

(10) Patent No.: US 7,533,461 B2
(45) Date of Patent: May 19, 2009

(54) METHOD FOR INTERCONNECTING ELECTRICAL CONDUITS IN A BOREHOLE

(75) Inventor: Neil Griffiths, Rijswijk (NL)

(73) Assignee: Shell Oil Company, Houston, TX (US)

( * ) Notice: Subject to any disclaimer, the term of this patent is extended or adjusted under 35 U.S.C. 154(b) by 63 days.

(21) Appl. No.: 10/575,417

(22) PCT Filed: Oct. 7, 2004

(86) PCT No.: PCT/EP2004/052471

§ 371 (c)(1),
(2), (4) Date: Mar. 16, 2007

(87) PCT Pub. No.: WO2005/038190

PCT Pub. Date: Apr. 28, 2005

(65) Prior Publication Data

US 2007/0275585 A1 Nov. 29, 2007

(30) Foreign Application Priority Data

Oct. 9, 2003 (EP) ..... 03256384

(51) Int. Cl.
*H01R 43/00* (2006.01)

(52) U.S. Cl. ..... 29/869; 29/825; 29/857; 29/874; 166/381

(58) Field of Classification Search ..... 29/825, 29/857, 869, 874, 876; 166/381
See application file for complete search history.

(56) References Cited

U.S. PATENT DOCUMENTS 3,835,929 A * 9/1974 Suman, Jr. ..... 166/384
5,132,624 A 7/1992 Kitson ..... 324/339
6,415,869 B1 * 7/2002 Smith ..... 166/381
7,112,080 B2 * 9/2006 Nicholson ..... 439/283

FOREIGN PATENT DOCUMENTS

| | | |
|---|---|---|
| FR | 2785728 | 5/2000 |
| GB | 2295409 | 5/1996 |
| WO | 01/02699 | 1/2001 |
| WO | 02/082590 | 10/2002 |

OTHER PUBLICATIONS

International Search Report PCT/EP2004/052471 dated Jan. 13, 2005.

* cited by examiner

*Primary Examiner*—C. J Arbes

(57) ABSTRACT

A method for interconnecting electrical conduits in an underground borehole by means of a self cleaning downhole electrical connector with a static and a moveable connector part, including installing the static connector part within the borehole such that a central throughbore within the static part provides a passage for fluid and debris passage and for access there beneath after retrieval of the moveable connector part; and lowering the movable connector part on top of the static connector part such that pairs of electrical contacts of the static and movable connector parts intermesh and fluid and debris is discharged via the central throughbore into the section of the borehole beneath the static connector part. The connector may be used to connect a wireline retrievable electrical submersible pump (ESP) system to an electrical power supply line which may remain in the borehole when the ESP system is retrieved for inspection, repair or replacement.

5 Claims, 1 Drawing Sheet

METHOD FOR INTERCONNECTING ELECTRICAL CONDUITS IN A BOREHOLE

BACKGROUND OF THE INVENTION

The invention relates to a method for interconnecting electrical conduits in an underground borehole and to an electrical submersible pump (ESP) system that may be connected to electrical power supply conduits at a downhole location by means of the method.

It is known from International patent application wO 01/02699 to provide a wireline retrievable electrical submersible pump (ESP) system with a wet mateable electrical connector which permits retrieval of the ESP system and associated electrical motor to surface for maintenance, inspection or replacement, without the need to simultaneously pull the electrical power supply cable to surface, which is often damaged during such retrieval and then needs to be replaced by a new cable. The wet mateable electrical connector known from this prior art reference comprises axially spaced pairs of electrical contact rings that are concentric in the wellbore, does, after retrieval of the ESP system, not permit access to the wellbore beneath and is vulnerable to fouling by wellbore solids debris, that are to be flushed from an annular space between the connector parts in which the electrical contact rings are arranged when they are joined.

GB 2295409 describes a known method for interconnecting electrical conduits. In the known method a static pin connector part is arranged co-axially in a well and a moveable box connector part is landed on top of the pin connector part such that debris can be discharged into the borehole. U.S. Pat. No. 5,132,624 discloses a downhole electrical connector with a central throughbore to permit passage of debris.

It is an object of the present invention to provide a wet mateable electrical connector, which is less prone to accumulation of debris and does not require flushing of debris from a space between the connector parts.

It is a further object of the present invention to provide a wet mateable-electrical connector, which comprises a static part and a moveable connector part, which is connectable to an ESP system, and of which the static connector part can be configured such that it permits access to the wellbore beneath the connector after retrieval of the ESP system and associated moveable connector part.

SUMMARY OF THE INVENTION

In accordance with some embodiments of the invention there is provided a method for interconnecting electrical conduits in an underground borehole by means of an electrical connector comprising a static and a moveable connector part which parts comprise pairs of intermeshing electrical contacts that are circumferentially spaced around the periphery of a central throughbore within the static connector part, which method comprises:

installing the static connector part substantially coaxially within the borehole or a borehole tubular such that the central throughbore provides a passage for fluid and debris and for access to the section of the borehole beneath the static connector part after retrieval of the moveable connector part; and lowering the movable connector part into the borehole on top of the static connector part such that the pairs of electrical contacts intermesh and that fluid and debris are discharged via the central throughbore into the section of the borehole beneath the static connector part, and wherein at least one connector part comprises at least one electrical contact, that is arranged in a sealed chamber comprising a dielectric fluid and an entrance opening which is configured to receive a mating electrical contact and which comprises a seal which is configured to inhibit contact between the dielectric and borehole fluids and to surround the electrical contacts when mated and to remain in sealing contact with the mating electrical contact after the electrical connection has been established by the connector.

BRIEF DESCRIPTION OF THE DRAWING

Several non-limitative embodiments of the method according to the invention will be described in more detail and by way of example with reference to the accompanying drawings, in which.

DETAILED DESCRIPTION OF A PREFERRED EMBODIMENTS

Figure 1:
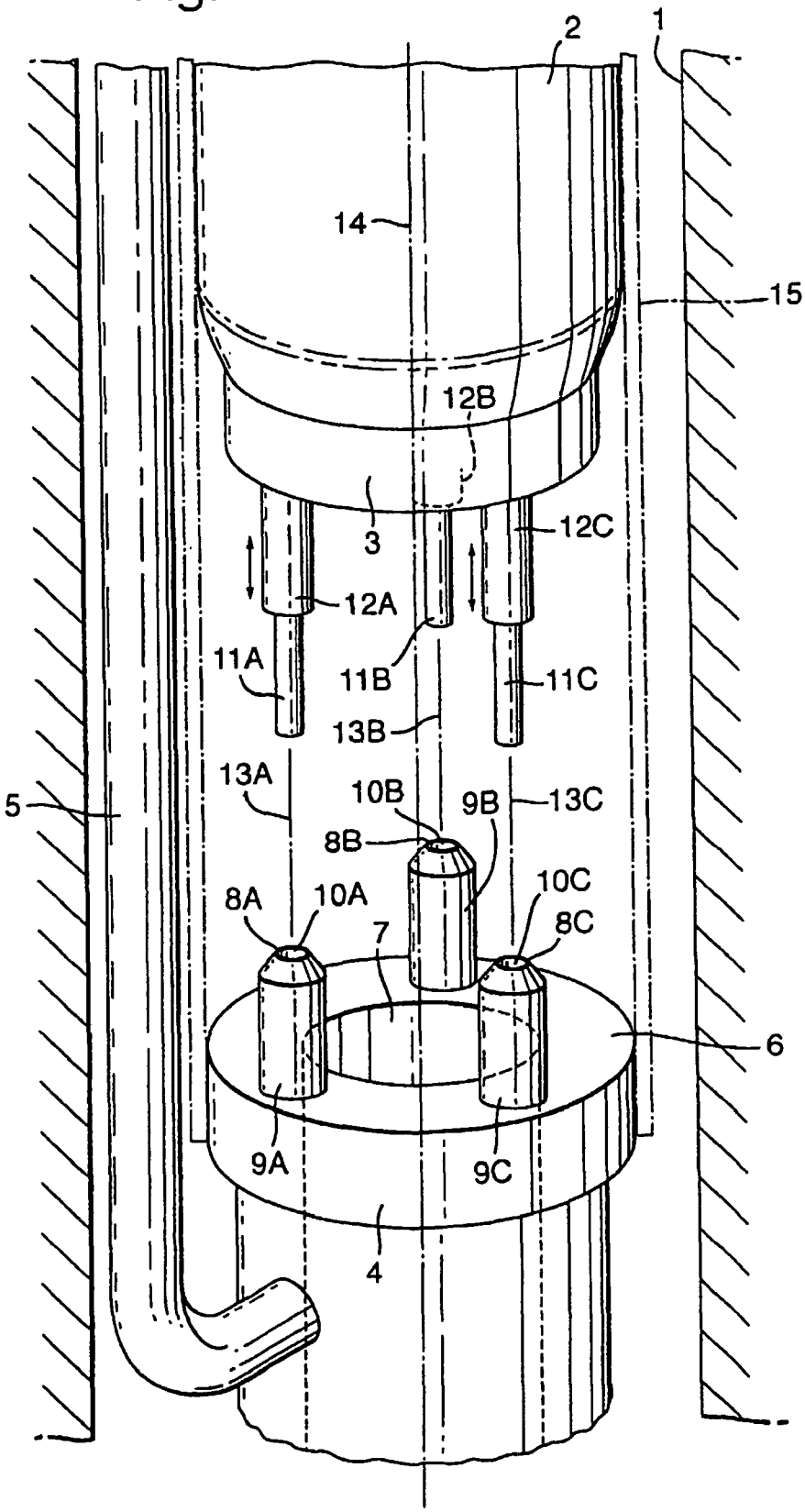
FIG. 1 depicts a schematic three-dimensional view of an ESP system and a self-cleaning downhole electrical connector according to the invention.

FIG. 1 shows a production tubing 1 of an oil production well into which an Electrical Submersible Pump (ESP) system 2, comprising an ESP and electrical motor assembly, is suspended from a wireline (not shown).

A moveable part 3 of a downhole electrical connector according to the invention is connected to the electrical motor (not shown) of the ESP system 2 and is located just above a static part 4 of the downhole electrical connector according to the invention.

The static connector part 4 is mounted within the production tubing 1 and is secured to a power supply cable string 5 which is suspended in the production tubing 1 and to which electrical power may be supplied by an electrical power source (not shown) at the earth surface.

The static connector part 4 comprises an annular housing 6 in which a central throughbore 7 is arranged and a set of three box sections 8A,8B and 8C extends up from the annular housing. Each box section 8A-C is arranged in a sealed chamber 9A-C which comprises an entrance opening 10A-C in which a seal is arranged which inhibits contact between a dielectric fluid within the chamber 9A-C and borehole fluids in the interior of the production tubing 1.

The static connector part may be mounted within a production tubing in a substantially vertical or inclined borehole and comprise:

a throughbore which is configured to permit passage of debris and borehole fluid into the interior of the borehole below the static connector part; and a set of at least two electrical contacts that are mounted at regular angular intervals relative to a central axis of the central throughbore. Thus if the connector is equipped with two pairs of intermeshing electrical contacts then the contacts may be spaced at angular intervals of 180 degrees relative to the central axis and if the connector is equipped with three pairs of electrical contacts then the contacts may be spaced at angular intervals of 120 degrees relative to the central axis.

The static connector part may be retrievably secured within a production tubing of an oil and/or gas production well and may comprise a plurality of electrical contacts, that are arranged at regular angular intervals around a central axis of the throughbore and/or production tubing and such that electrical contacts of the static part define longitudinal axes along which the mating contacts of the moveable connector part slide into the sealed chambers and which are substantially parallel to the central axis. The moveable connector part 3 comprises a set of three pin sections 11A-C, which are configured to penetrate through the seals into the box sections 8A-C, such that when the connector parts 3 and 4 have been joined any electrically conducive parts of the pin sections 11A-C are arranged within the sealed chambers 9A-C and are not in contact with any borehole fluids.

The moveable connector part may be connected to an electrical submersible pump (ESP) system or other electrical assembly, such as a downhole gas compressor.

In such case the moveable electrical connector part may be provided with a plurality of retractable electrical contacts, which are retracted within one or more sealed sections of the moveable electrical connector part during the descent of the pump system into the production tubing and which are configured to slide out of said sealed sections of the moveable electrical connector part and to contact the corresponding electrical contact within a sealed chambers within the static electrical connector part.

The pin sections 11A-C may be arranged in protective sleeves 12A-C or a protective housing which inhibits fouling of the pin sections 11A-C during the descent into the wellbore and such that the sleeves 12A-C or housing is retracted by the lower connector part 4, thereby minimizing exposure of the pin sections 11A-C to wellbore fluids.

The moveable and static connector part 3 and 4 are provided with an alignment assembly 15 with intermeshing axial grooves and guide pins (not shown) for accurate alignment of the pins 11A-C to the corresponding boxes 11A-C when the connector parts are being joined, such that the pins 11A-C slide along longitudinal axes 13A-C into the boxes 8A-C, which axes 13A-C are substantially parallel to a central axis 14 of the central throughbore 7 and of the production tubing 1.

The pin and box assemblies of the moveable and static connector parts 3 and 4 may be configured as disclosed in International patent application WO2002/082590.

Some embodiments of the invention have one or more of the following advantages. The downhole electrical connector is self cleaning and debris is not trapped between the connector parts 3 and 4 so that there is no requirement to flush a dielectrical fluid around the pin and box sections 8 and 11A-C to remove any fouling, debris and/or wellbore fluids.

Debris and borehole fluids can easily flow from the spacing between the connector parties into the central throughbore and the circumferentially spaced, or nonconcentric, arrangement of the electrical contacts, preferably adjacent to the central throughbore, further promotes that debris is flushed away from the spacing between connector parts when they are joined.

I claim:

1. A method for interconnecting electrical conduits in an underground borehole by means of an electrical connector comprising a static and a moveable connector part, which parts comprise pairs of intermeshing electrical contacts that are circumferentially spaced around the periphery of a central throughbore within the static connector part, which method comprises:

installing the static connector part substantially coaxially within the borehole or a borehole tubular such that the central throughbore provides a passage for fluid and debris and for access to the section of the borehole beneath the static connector part after retrieval of the moveable connector part; and lowering the movable connector part into the borehole on top of the static connector part such that the pairs of electrical contacts intermesh and that fluid and debris are discharged via the central throughbore into the section of the borehole beneath the static connector part;

wherein at least one connector part comprises at least one electrical contact, that is arranged in a sealed chamber comprising a dielectric fluid and an entrance opening which is configured to receive a mating electrical contact and which comprises a seal which is configured to inhibit contact between the dielectric and borehole fluids and to surround the electrical contacts when mated and to remain in sealing contact with the mating electrical contact after the electrical connection has been established by the connector.

2. The method of claim 1, wherein the static connector part is mounted within a production tubing in a substantially vertical or inclined borehole and comprises:

a throughbore which is configured to permit passage of debris and borehole fluid into the interior of the borehole below the static connector part; and a set of at least two electrical contacts that is mounted at regular angular intervals relative to a central axis of the central throughbore.

3. The method of claim 1, wherein the static connector part is retrievably secured within a production tubing of an oil or gas production well and comprises a plurality of electrical contacts, that are arranged at regular angular intervals relative to a central axis of the throughbore or production tubing and such that the electrical contacts of the static connector part define longitudinal axes along which the mating contacts of the moveable connector part slide into the sealed chambers and which are substantially parallel to the central axis.

4. The method of claim 3, wherein the moveable connector part is connected to an electrical submersible pump system or other electrical apparatus.

5. The method of claim 4, wherein the moveable electrical connector part is provided with a plurality of retractable electrical contacts, which are retracted within one or more sealed sections of the upper electrical connector part during the descent of the pump system into the production tubing and which are configured to slide out of said sealed sections of the movable electrical connector part and to contact the corresponding electrical contact within a sealed chambers within the static electrical connector part.

* * * * *